US005376997A

United States Patent [19]

Yamato et al.

[11] Patent Number: 5,376,997

[45] Date of Patent: Dec. 27, 1994

[54] ROTATING SLEEVE-TYPE MAGNETIC BRUSH CLEANING DEVICE

[75] Inventors: Seiho Yamato; Satoshi Haneda, both of Hachioji, Japan

[73] Assignee: Konica Corporation, Tokyo, Japan

[21] Appl. No.: 14,635

[22] Filed: Feb. 8, 1993

[30] Foreign Application Priority Data

Feb. 13, 1992 [JP] Japan ..... 4-026814
Aug. 7, 1992 [JP] Japan ..... 4-211435

[51] Int. Cl.[5] ..... G03G 21/00

[52] U.S. Cl. ..... 355/305; 355/296; 355/301

[58] Field of Search ..... 355/305, 301, 296, 215, 355/298; 118/652

[56] References Cited

U.S. PATENT DOCUMENTS

| | | | |
|---|---|---|---|
| 4,116,555 | 9/1978 | Young et al. | 355/305 |
| 4,402,103 | 9/1983 | Yanagawa et al. | 355/305 X |
| 4,502,780 | 3/1985 | Suzuki et al. | 355/305 |
| 4,515,467 | 5/1985 | Suzuki | 355/305 |
| 4,552,451 | 11/1985 | Yamazaki et al. | 355/305 |
| 4,641,956 | 2/1987 | Seanor | 355/305 |
| 4,870,449 | 9/1989 | Brown | 355/298 X |
| 4,918,488 | 4/1990 | Creveling et al. | 355/305 X |
| 4,989,021 | 1/1991 | Ochiai et al. | 355/305 X |
| 5,012,288 | 4/1991 | Tavernier et al. | 355/305 X |
| 5,138,382 | 8/1992 | Van Duser et al. | 355/215 |
| 5,182,601 | 1/1993 | Hodoshima et al. | 355/305 X |

FOREIGN PATENT DOCUMENTS

| | | |
|---|---|---|
| 57-164777 | 10/1982 | Japan . |
| 1-59587 | 12/1989 | Japan . |

*Primary Examiner*—A. T. Grimley
*Assistant Examiner*—Shuk Y. Lee
*Attorney, Agent, or Firm*—Frishauf, Holtz, Goodman & Woodward

[57] ABSTRACT

A rotating sleeve-type magnetic brush cleaning apparatus removes residual toner from a peripheral surface of an image carrying member of an image former. The apparatus comprise a magnetic brush that includes electrically insulated magnetic particles provided on an outer surface of the rotating sleeve which sweep the peripheral surface of the image carrying member; and a voltage source for applying a superposed electric potential including a DC voltage component and an AC voltage component between the image carrying member and the magnetic brush. The magnetic brush is biased to a potential which is reverse in polarity to an electrification polarity of the toner by the DC potential.

8 Claims, 4 Drawing Sheets

ROTATING SLEEVE-TYPE MAGNETIC BRUSH CLEANING DEVICE

BACKGROUND OF THE INVENTION

The present invention relates to an improvement of a cleaning unit to be used in an electrophotographic copying machine or in an electrostatic recording apparatus, and more particularly, to an improvement of a magnetic brush type cleaning unit which removes toners staying on an image carrier with a magnetic brush.

An electrophotographic copying machine of a transfer type requires a cleaning unit that removes residual toners on an image carrier for the purpose of preparing for the succeeding development after a toner image has been transferred onto a transfer sheet, and a magnetic brush is used as one of the cleaning means in some copying machines.

However, there have been problems in a magnetic brush type cleaning means.

The first problem is that the magnetic brush type cleaning means is weak in force to sweep the surface of an image carrier compared with a conventional blade type cleaning means, and therefore, it is difficult for the magnetic brush type cleaning means to remove thoroughly the residual toners, though it has an advantageous point that it hardly hurts the surface of the image carrier.

With an aim to solve the problem mentioned above, Japanese Patent Examined Publication No. 59587/1989 (1-59587) discloses a magnetic brush type cleaning device wherein DC and AC bias voltage are impressed between an image carrier and a magnetic brush sleeve.

Compared with a conventional magnetic brush type cleaning unit, the magnetic brush type cleaning device mentioned above can exhibit higher cleaning effect because mechanical sweeping force as well as electric Coulomb force are used for cleaning.

However, when using toners having a small particle size, especially when using toners of spherical particles having a size of not more than 7 μm, it has been difficult to remove thoroughly the residual toners on the surface of an image carrier even when the magnetic brush type cleaning device mentioned above is used. For the reason mentioned above, development of a cleaning device capable of coping fully with toners of smaller size particles which are considered to become popular more and more in the future.

The second problem of the magnetic brush type cleaning means is that the releasing of the cleaning means is complicated.

For example, in an electrophotographic copying machine having a process wherein an image carrier is rotated several times for superposing toners, when a cleaning member is kept to continue sweeping an image carrier constantly, a visible image is wiped off before it is transferred, which is a problem. In the past, therefore, there has been a switching means wherein a sleeve on which a magnetic brush is formed is made to be movable, and thereby the distance between the sleeve and an image carrier is changed so that an ear of the magnetic brush may be in pressure-contact with or be away from the image carrier.

When such switching means as stated above is used, however, the distance between the magnetic brush sleeve and the image carrier for cleaning is not stable, being changed each time the cleaning means is released, which can cause insufficient cleaning. In order to keep that distance at a certain accuracy constantly, in that case, a mechanism for releasing the cleaning means tends to be complicated, resulting in undesirable conditions in terms of maintenance, a size of an electrophotographic apparatus and price thereof.

SUMMARY OF THE INVENTION

The invention has been achieved based on design and fabrication of an experimental model made after studying cleaning ability for toners of small particles and cleaning conditions. Its object is to provide a magnetic brush type cleaning device capable of removing residual toners from the surface of an image carrier even when small particle toners are used, having high effect of cleaning, and its further object is to provide a device wherein pressure-contact of a magnetic brush to an image carrier can be released by a simple mechanism when the device is out of the cleaning operation.

The above mentioned object of the present invention is attained by a magnetic brush type cleaning device which removes residual toner from a surface of an image carrying body of an image forming apparatus after the transfer of a toner image from the surface of the image carrying body, the toner image being formed on the surface by a superposition of developed toner images from electrostatic latent images, wherein the magnetic brush type cleaning device is provided with a power supply means that impresses a superposed potential of a DC potential and an AC potential between the image carrying body and a sleeve of the magnetic brush type cleaning device in a manner that the sleeve is biased by the DC potential to a potential polarity which is reverse to an electrification polarity of the toner.

The above mentioned object is further attained by a magnetic brush type cleaning device which removes residual toner from a surface of an image carrying body of an image forming apparatus after the transfer of the toner image from the surface of the image carrying body, wherein the magnetic brush type cleaning device is characterized in that it is provided with a magnetic brush controlling means that controls transportation of magnetic particles constituting the magnetic brush by an oscillation of a control magnet. In the oscillation, a magnetic pole which is reverse in magnetic polarity to a nearest magnetic pole of a plurality of magnets in a rotating sleeve of the magnetic brush type cleaning device.

DETAILED DESCRIPTION OF PREFERRED EMBODIMENTS

Figure 1:
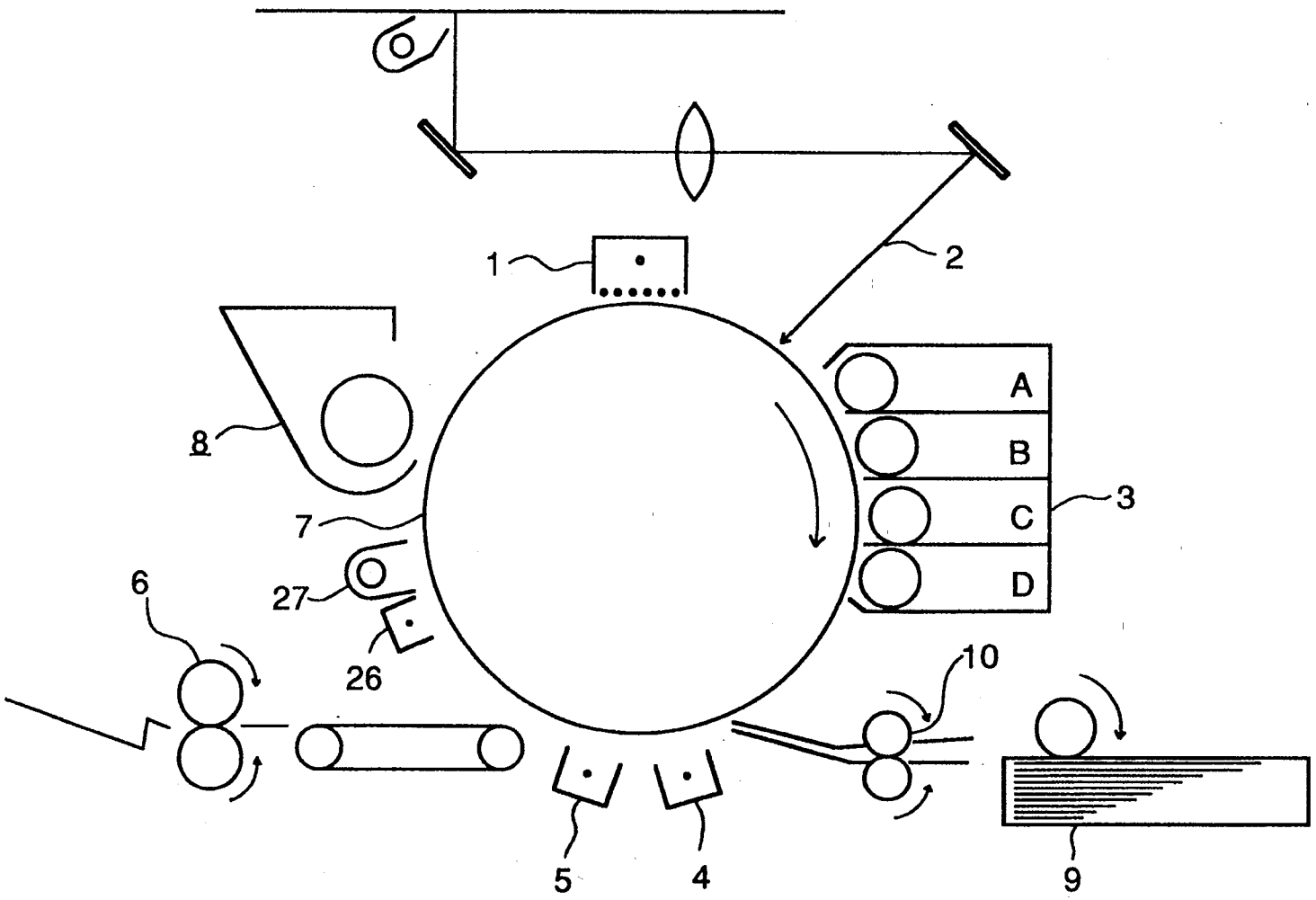
FIG. 1 is a sectional view showing a schematic structure of an electrophotographic copying machine which is an example of the invention and FIG. 2 is a sectional side view of a main portion showing an example of a cleaning device of the invention.

FIG. 1 is a sectional view showing a schematic structure of an electrophotographic copying machine which is an example of the invention. In the electrophotographic copying machine shown in the figure, a support of photoreceptor drum 7 which is an image carrier is made of conductive and non-magnetic material such as aluminum and its surface is mirror-finished so that a light-sensitive layer of selenium or organic semiconductor may be provided thereon through evaporation or coating. In the figure, the photoreceptor drum 7 is rotating clockwise.

Image light 2 modulated from an exposure unit based on document images is applied on the photoreceptor drum 7 for exposure therefor and thereby electrostatic latent images are formed on the surface of the photoreceptor drum 7 which is charged uniformly by charging unit 1. The electrostatic latent image is first subjected to reversal development made by the first developing unit (A) having therein yellow developers among 4 developing units provided in developing device 3, thus a yellow toner image is formed on the photoreceptor drum 7. The photoreceptor drum 7 continues making one turn and when the electrostatic latent image arrives at a position of the developing device 3 again, reversal development is made by the second developing unit (B) having therein magenta developers, thus magenta toner images are superposed on the aforementioned yellow toner images. In the same manner, a cyan toner image formed by the third developing unit (C) having therein cyan developers after further one turn of the photoreceptor drum 7 are superposed and black toner images formed by the fourth developing unit (D) having therein black toners after still further one turn of the photoreceptor drum 7 are superposed. Finally, toner images composed of four superposed toner images each having its own color are formed on the surface of the photoreceptor drum 7, to which, however, the invention is not limited.

Four differently colored toner images superposed on the photoreceptor drum 7 are transferred by transfer unit 4 onto a recording sheet which is fed out of sheet feeding cassette 9 by sheet feeding roller 10. In this case, the timing and speed of the sheet coincide with the timing and the speed of the toner images to an extent that the leading edge of the toner images arrives at the transfer unit 4 at the same time when the leading edge of the recording sheet arrives there. In that case, 60–90% of toners forming the toner images are transferred onto the recording sheet, but 5–20% of them stay on the surface of the photoreceptor drum 7 to be residual toners.

After the recording sheet is separated from the photoreceptor drum 7 and the photoreceptor drum 7 is charged by charging unit 26, the residual toners are neutralized by light of uniform exposure lamp (neutralizing lamp) 27, and absorbed in a magnetic brush of a magnetic brush type cleaning device 8, thus they are removed from the photoreceptor drum 7. On the other hand, the recording sheet separated from the photoreceptor drum 7 by separating unit 5 after transferring is transported to fixing unit 6 where transferred document images are fused.

Figure 2:
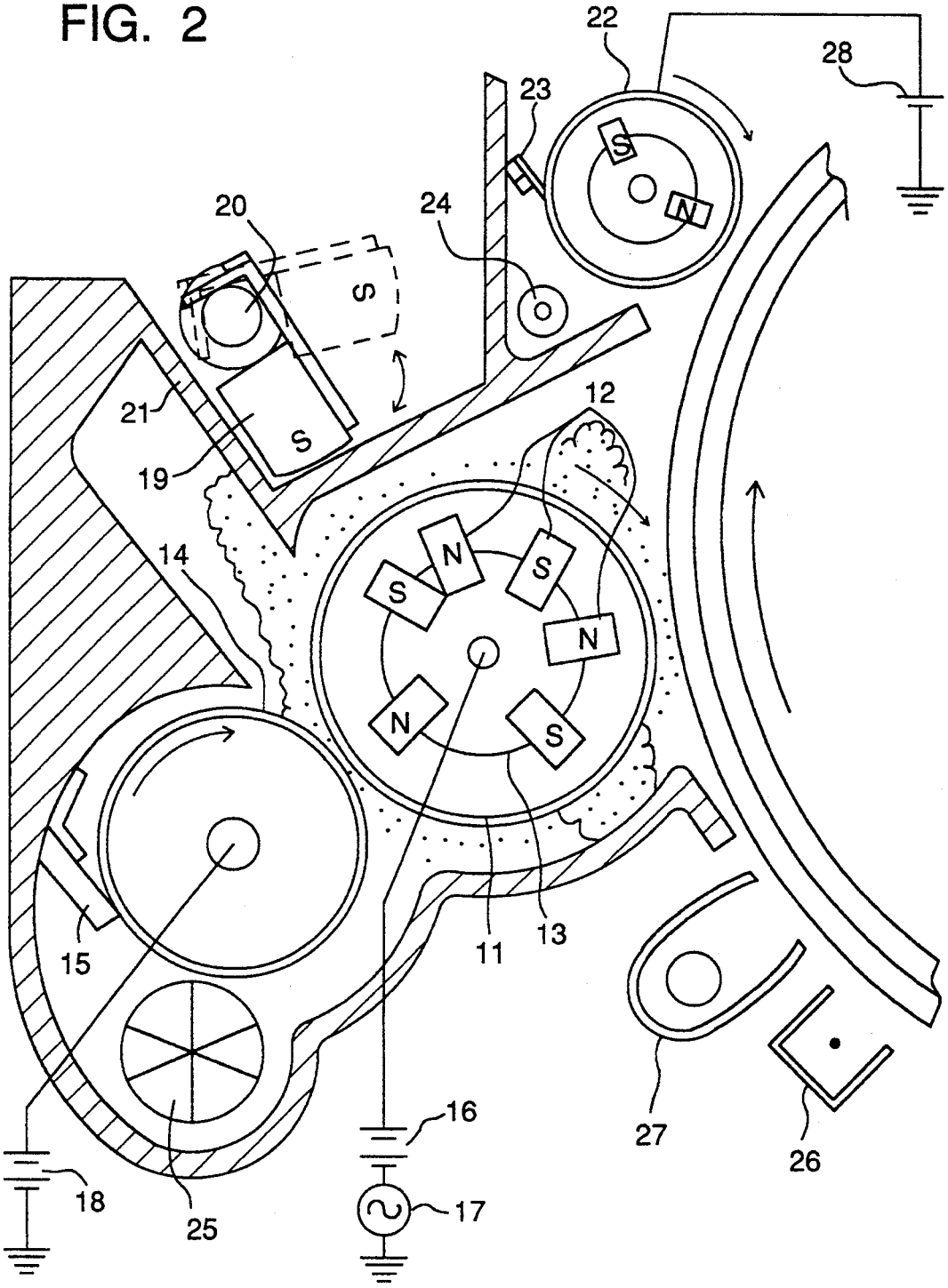

FIG. 2 is a sectional side view of main portions showing an example of a cleaning device of the invention.

Toners to be cleaned are subjected to neutralizing by means of light of neutralizing lamp 27 after the charging by means of charging unit 26. Thereby, charges on the surface of the photoreceptor are removed, and electric potentials of toners mainly remain.

A magnetic field of a plurality of magnets 12 held by magnet-holding roller 13 forms a magnetic brush consisting of carriers which are magnetic particles on the surface of magnetic brush sleeve 11 made of conductive non-magnetic materials. In this case, a magnetic pole on one side of each magnet 12 faces an inner surface of sleeve 11, and magnetic poles of magnets adjoining each other in the circumferential direction are different in polarity, as shown in the figure. Further, in the figure, only one magnet out of a plurality of magnets 12 is provided to be closest to the surface of the photoreceptor drum 7. The invention, however, is not limited to this, and for the purpose of enhancing a cleaning effect, a plurality of magnets may be positioned to be closest to the surface of the photoreceptor drum 7.

Ears of a magnetic brush formed on the sleeve 11 revolve clockwise when the sleeve 11 rotates and brush the surface of the photoreceptor drum 7 to remove residual toners and paper dust.

Between the photoreceptor drum 7 and the sleeve 11, in this case, DC bias voltage that attracts toners on the surface of the photoreceptor drum 7 to the sleeve 11 and AC bias voltage that gives oscillating electric field to toners on the photoreceptor drum 7 are impressed respectively by DC bias voltage power supply 16 and AC bias voltage power supply 17 both of which are power supply means, thus residual toners staying on the surface of the photoreceptor drum 7 are attracted to the sleeve 11.

Residual toners attracted to the sleeve 11 are then attracted to toner recovery roller 14 made of the same material as the sleeve 11 on which DC bias voltage for toner recovery is impressed by DC bias voltage power supply 18 for toner recovery. The toner recovery roller 14 is provided with blade 15 that is kept in pressure-contact with the surface of the roller in the state of inclination toward the direction of movement of the roller surface. The blade 15 is made of a material having appropriate elasticity such as, for example, hard resins, and it scrapes off the aforementioned toners attracted to the surface of the roller 14, and toners thus scraped off are conveyed by toner recovery screw 25 for recovery. With regard to the difference between DC bias voltage for recovery and DC bias voltage for cleaning, it is set so that toners may move toward the roller 14 for recovery.

With regard to charging by means of charging unit 26 that is conducted before cleaning, its polarity identical to that of toners in the course of development can enhance cleaning efficiency. When considering that a photoreceptor is neutralized by light, a method of reversal development is preferable in structure because polarity of charged toners agrees with that of charged photoreceptor.

In regular development, it is preferable that a photoreceptor capable of being charged to both polarity is used and it is charged to the polarity that is opposite to the polarity of charging in the course of image forming. This makes it possible to neutralize with light and eliminate charges on the photoreceptor.

Above the sleeve 12 in FIG. 2, on the other hand, there is provided magnetic brush controlling magnet 19 having a magnetic pole that is different from that of magnet 12 closest to the surface of a photoreceptor, so that it may rotate in the arrowed direction around shaft 20. There is further provided partition wall 21 between the magnetic brush controlling magnet 19 and the sleeve 11 so that no carriers may stick directly to the magnetic brush controlling magnet 19. When the surface of the photoreceptor drum 7 needs to be cleaned, the magnetic brush controlling magnet 19 is in a position shown with dashed lines in FIG. 2, and carriers constituting a magnetic brush are conveyed in the clockwise direction when the sleeve 11 rotates, thus cleaning is carried out. When no cleaning is needed, however, the magnetic brush controlling magnet 19 is moved by an unillustrated magnet controlling means to the position shown with solid lines. Transportation of carriers, in this case, is discontinued by a facing magnetic field between the magnetic brush controlling magnet 19 and the magnet 12, and thereby it does not happen that the surface of the photoreceptor drum 7 is brushed by the magnetic brush for cleaning.

Incidentally, a magnetic substance may be used in place of the magnetic brush controlling magnet 19 in this case, and when an electromagnet is used, a releasing mechanism can be further simplified because a cleaning means can be either activated or released depending only on either the electromagnet is electrified or not.

Furthermore, it tends to be a cause for carriers to stick to the photoreceptor drum 7 to impress high AC bias voltage or to enhance a linear speed ratio of cleaning agents to a sleeve drum or an amount of cleaning agents to be transported. Under some cleaning conditions, therefore, carriers staying on the photoreceptor drum 7 need to be recovered after cleaning. It is therefore preferable to provide at the downstream side in the rotating direction of photoreceptor drum 7 a carrier recovery means, for example, wherein carriers are collected by a sleeve or a magnetic roller to be used again as a magnetic brush. An example in FIG. 2 is provided with a carrier recovery means composed of carrier collecting sleeve 22, carrier scraping off blade 23 and carrier conveying screw 24 for returning carriers collected into an unillustrated carrier tank. With regard to bias voltage produced by bias voltage power supply 28, it may be superposed with AC components, and voltage of 0–±100 V is impressed as DC components. Owing to this, unnecessary toners or carriers do not stay on the photoreceptor, and carriers can be collected by magnetic force.

Next, magnetic particles for forming a preferable magnetic brush and cleaning conditions therefor in a device of the present example will be explained as follows.

First, a particle size of magnetic particles will be explained. In general, a large average particle size of magnetic particles makes a shape of an ear of a magnetic brush formed on a) a holding-carrier to be rough, and unevenness tends to occur on the magnetic brush, resulting in a problem of uneven cleaning, even when charging while giving vibration by means of an electric field. A method to solve this problem, is to make an average particle size of carrier particles to be small, and experiments have proved that an average particle size of 150 μm or less starts solving the problem and an average particle size of 100 μm or less, in particular, eliminates the problem of a) substantially. However, when particles are too small, they stick to the surface of an image carrier in the course of charging, or they tend to scatter. These phenomena, though they depend on magnetic field intensity acting on particles and on intensity of magnetization of particles thereby, take place clearly with an average particle size of 30 μm or less, generally. Incidentally, intensity of magnetization of 20–200 emu/g is preferably used.

From the foregoing, a preferable particle size is within a range from 30 μm to 150 μm, and a more preferable range is from 30 μm to 100 μm.

Magnetic particles mentioned above are obtained when ferromagnetic particles such as metal including iron, chromium, nickel and cobalt, or their compounds and alloys such as, for example, tri-iron tetroxide, γ-ferric oxide, chromium dioxide, manganese oxide, ferrite and manganese-copper alloy, or particles obtained by coating the surfaces of the aforesaid ferromagnetic particles with resins such as styrene resin, vinyl resin, ethylene resin, rosin-modified resin, acrylic resin, polyamide resin, epoxy resin and polyester resin, or obtained by making with resins containing dispersed magnetic fine particles, are sorted in terms of particle size by a known average particle size sorting means.

Magnetic particles each being spherical in shape also provide an advantageous point that a uniform layer of particles is formed on a particle-carrier and high bias voltage can be impressed evenly on the particle-carrier. Namely, magnetic particles usually tend to be magnetized and absorbed in the direction of their major axes. (1) However, spherical particles have no directional drift or polarity, and thereby a layer can be formed uniformly without having a local area of low resistance or unevenness of layer thickness. (2) In spherical particles, together with high resistance of magnetic particles, edge portions observed on conventional particles have been eliminated causing no concentrated electric field on the edge portion. As a result, even when high bias voltage is impressed on a magnetic particle carrier, no arcing takes place on the surface of an image carrier, resulting in no uneven cleaning, which is an advantageous point. With regard to a spherical particle offering the aforementioned effect, it is preferable to form insulating magnetic particles so that they may have their electrical resistivity of not less than $10^8\Omega$.cm, especially of $10^{12}\Omega$.cm. This electrical resistivity is a value obtained through the method wherein particles are put in a container having a sectional area of 0.50 $cm^2$ and tapped, and then a load weighing 1 $kg/cm^2$ is applied on the stuffed particles, and a value of current is read when voltage causing an electric field of 1000 V/cm between the load and an electrode on the bottom is applied. When bias voltage is impressed on a particle-carrier under the condition of low electrical resistivity, electric charges are impregnated into magnetic particles and thereby magnetic particles tend to adhere to the surface of an image carrier, or breakdown of bias voltage tends to occur.

When integrating the foregoing, it is found that the conditions wherein the ratio of a major axis to a minor axis of a particle is not more than 3, no protrusion such as a needle portion or an edge portion is present, and electrical resistivity is not less than $10^8\Omega$.cm, preferably is not less than $10^{12}\Omega$.cm are pertinent for the magnetic particles. The spherical magnetic particles satisfying the above-mentioned conditions are manufactured by selecting spherical particles as far as possible for magnetic particles, by conducting a process of forming a spherical shape after the formation of dispersed resin particles by using magnetic fine particles as far as possible in the case of particles having dispersed magnetic fine particles, or by causing dispersed resin particles to be contained through a spray-dry method.

The foregoing represents conditions for magnetic particles, and conditions for a magnetic particle carrier which forms thereon a particle layer and charges electrically an image carrier will be explained as follows.

As a magnetic particle carrier, a carrier capable of being impressed with bias voltage is used, and in particular, a carrier provided with a magnet body having a plurality of magnetic poles inside a sleeve thereof on the surface of which a particle layer is formed is preferably used. In a carrier having the structure mentioned above, a particle layer formed on the surface of a sleeve moves while undulating in a shape of a wave because of a relative rotation against a rotating magnet body. Therefore, even when fresh magnetic particles are supplied in succession to cause slightly uneven thickness of a particle layer formed on the surface of the sleeve, influence of the uneven thickness is offset by the undulation in a shape of a wave so that no problem may be caused. It is preferable that the carrying speed for magnetic particles caused by a rotation of the sleeve or further by a rotation of the magnet body is identical to or higher than the moving speed of an image carrier. Further, the carrying direction caused by a rotation of the sleeve which is the same as that of the sleeve rotation is preferable. The same direction offers, compared with an opposite direction, better uniformity in charging. However, the invention is not limited to them.

It is preferable that a thickness of a particle layer formed on a particle-carrier is one which can be regulated fully by a thickness-regulating plate to be a uniform layer, and a clearance between the particle-carrier and the image carrier which ranges from 100 μm to 2000 μm is preferable. When a clearance between the surface of the particle-carrier and that of the image carrier is narrower than 100 μm excessively, it becomes difficult to form an ear of a magnetic brush for cleaning evenly for that clearance, making it impossible to supply sufficient magnetic particles to a cleaning portion, which stands in the way of stable cleaning. When the clearance exceeds 2000 μm remarkably, a particle layer is formed roughly, thereby uneven cleaning tends to happen, and an effect of an oscillating electric field is lowered, making sufficient cleaning impossible. As stated above, when a clearance between the particle-carrier and the image carrier takes an extreme value, it is impossible to make a particle layer on the particle-carrier to be in optimum thickness for that clearance. However, when the clearance is in a range of 100–2000 μm, it is possible to make the thickness of the particle layer to be optimum, thus occurrence of scratched images caused by rubbing of a magnetic brush can be prevented.

It is preferable that magnetic particles are subjected to frictional electrification so that the particles are electrified to a polarity opposite to that of toners without changing the electrified polarity of the toners in development. Owing to frictional electrification of toners, it is possible to improve their recovery function. An electrification amount in this case is preferably 5–50 μc/g under the condition of 5 parts by weight of toners against 100 parts by weight of magnetic particles.

In the present example, cleaning was conducted without transferring solid images formed through reversal development, and an amount of toners staying on a photoreceptor after cleaning was measured by means of reflection density for evaluating the cleaning efficiency. An example of preferable cleaning conditions is as follows.

Cleaning conditions

Toner: $d_{50}$=0.5–10 μm (spherical)

Carrier: $d_{50}$=30–100 μm (spherical)

Magnetic brush sleeve:

Diameter=20–40 mm

Flux density=500–1100 gauss

Linear speed ratio to photoreceptor drum=0.8–3.0

$D_{sd}$: 100–200 μm (gap between magnetic brush sleeve and photoreceptor drum)

Voltage to be impressed on magnetic brush sleeve:

$V_{DC}$=0–300 V (opposite to toner in polarity)

$V_{pp}$=200–3500 V (between-peaks voltage of AC components)

$f_{AC}$=0.5–10 k Hz

Carried amount on sleeve: 10–200 mg/cm$^2$

Example 1

Figure 3:
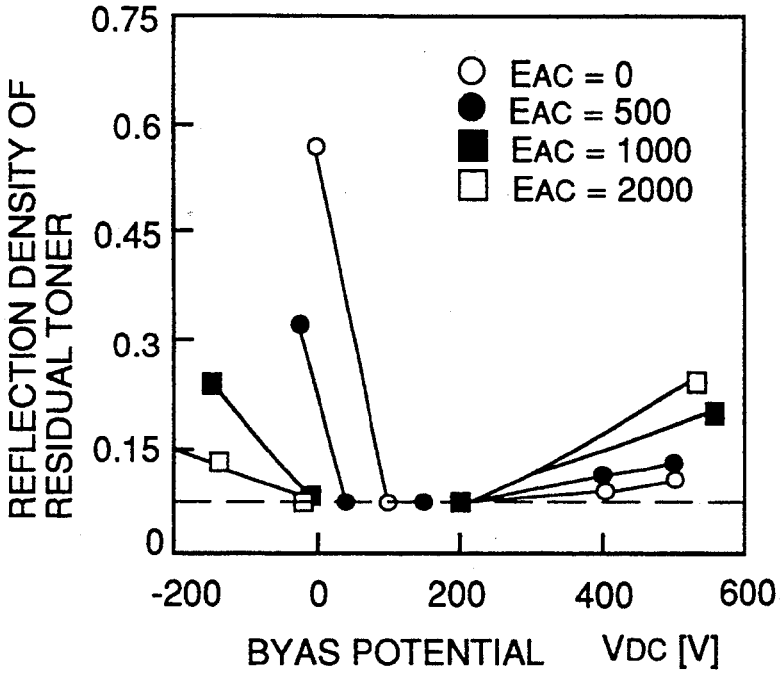
FIG. 3 is a diagram showing the results of an investigation into influence of bias voltage impressed on a sleeve.

FIG. 3 represents an influence exerted upon cleaning efficiency by bias voltage impressed on sleeve 11.

The axis of abscissas in FIG. 3 represents DC bias voltage, the axis of ordinate represents reflection density of residual toners after cleaning, and a portion of dashed lines represents reflection density without residual toners.

FIG. 3 shows that cleaning efficiency in the low DC bias voltage zone is improved rapidly as DC bias voltage $V_{DC}$ is enhanced. In addition, it is considered that cleaning efficiency is not lost even in the area of $V_{DC}$=0, because both magnetic particles and toner particles are subjected to frictional electrification each other. In the high DC bias voltage zone, on the other hand, slight background fog which has been caused by insufficient AC bias voltage is eliminated and a cleaning area of DC bias voltage is expanded. However, the reason for that the more intense the AC bias voltage impression is the worse the cleaning is in the higher DC bias voltage zone is not clear. The reason for this is considered that toners once removed for cleaning are transferred back again and deposited, or that toner polarity is changed by partial discharging.

Figure 4:
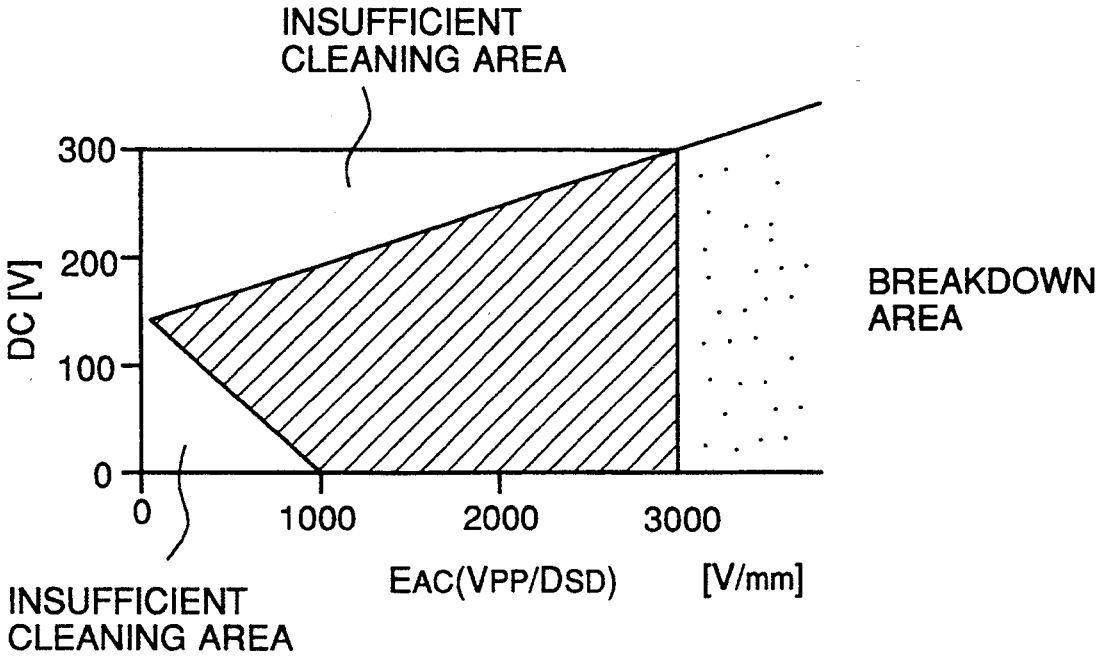
FIG. 4 is a diagram showing the relation between the cleaning efficiency and bias voltage.

When between-peaks voltage $V_{PP}$ of AC bias voltage is changed, a cleaning area as shown in FIG. 4 is present for DC bias voltage, and when AC bias voltage is enhanced, a cleaning area is expanded, especially in the low DC bias zone. The axis of ordinate in FIG. 4 represents DC bias voltage, the axis of abscissas represents $E_{AC}$=VPP/$D_{sd}$ (volt/mm) that is a value obtained by dividing VPP with $D_{sd}$.

It was confirmed from the figure that when DC bias voltage is enhanced, insufficient cleaning which is fog takes place and when the DC bias voltage is further enhanced, the fog is worsened. Therefore, excellent cleaning is attained when the DC bias voltage is within a range of 0–300 V. The results were obtained with frequency ranging from 0.5 KHz to 10 KHz.

The conditions for $V_{DC}$ and $E_{AC}$ are as follows.

$$V_{DC} \leqq 0.05\ E_{AC} + 150$$

$$V_{DC} \geqq -0.15\ E_{AC} + 150$$

For the development in the present example, toner particles identical in terms of polarity to electrostatic latent images are used. However, the invention is not limited to this, but the so-called regular development wherein toner particles having polarity that is opposite to that on the charged surface are caused to adhere to high potential portions may also be employed.

In the invention, preferable bias voltage to be impressed on sleeve 11 includes DC bias voltage of 0–300 V and AC bias voltage of 0.2–3.0 KV at frequency of 0.5–10 KHz, including the case of reversal development.

When a transporting amount is within a range of 10–20 mg/cm$^2$ no big change is observed in a cleaning area, but as the transporting amount is increased, there is a tendency that cleaning efficiency is improved.

When the linear speed ratio of transport speed for cleaning agents to a drum of a sleeve is 0.8–3.0, cleaning efficiency is improved as the transport speed is enhanced. However, the transport speed less affects cleaning efficiency compared with AC bias voltage described above, and the linear speed ratio ranging from 1.2 to 2.5 is especially preferable.

Figure 5:
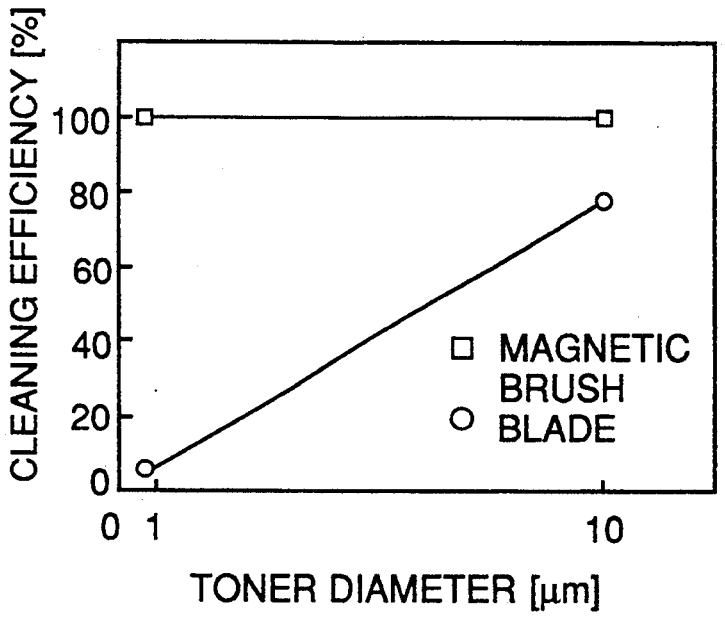
FIG. 5 is a diagram showing a comparison between blade type cleaning and magnetic brush type cleaning and relation between cleaning efficiency and toner particle size.

For clarifying the effect of the invention, comparison with blade type cleaning for spheric toners was made, and how the cleaning efficiency is dependent on a toner particle size was further investigated, which are all shown in FIG. 5. Incidentally, in the comparison mentioned above, a cleaning blade made of urethane rubber which is used in U-Bix 8028 made by Konica Corp. was used as a blade for the comparison.

In FIG. 5, the axis of abscissas represents a toner particle size and the axis of ordinate represents cleaning efficiency. The cleaning efficiency, in this case, means a value obtained by substituting $R_1$ and $R_2$ which are respectively obtained amount of staying toners before cleaning and that after cleaning for $R_1$ and $R_2$ in the following expression.

$$\text{Cleaning efficiency } [\%] = (R_1 - R_2) / R_1 \times 100$$

FIG. 5 shows that blade type cleaning does not show sufficient cleaning even for a toner particle size of 10 μm and its cleaning efficiency is further worsened for the smaller toner particle size, while magnetic brush type cleaning makes it possible to clean spheric toners ranging in particle size from 0.5 μm to 10 μm.

The cleaning unit of the invention described above expresses a remarkable effect that toners having a small particle size of 0.5 μm or more being unable to be cleaned by a conventional cleaning device can be cleaned almost thoroughly, and it also expresses another effect that the cleaning unit can be released by a simple mechanism.

What is claimed is:

1. A cleaning apparatus of a magnetic brush type for use in an image former which develops an electrostatic latent image into a toner image of insulated chargeable toner on a peripheral surface of an image carrying member and transfers the toner image onto a recording sheet, for removing residual toner, including toner having a spherical particle size of not more than 7 μm, after the transfer of the toner image from the peripheral surface, the cleaning apparatus comprising:

magnetic brush forming means having a rotating sleeve and a plurality of magnets located in stationary and radial dispositions in an inner space of the rotating sleeve, for forming a brush of electrically insulated spherical magnetic particles on an outer surface of the rotating sleeve so as to sweep the peripheral surface of the image carrying member by the magnetic brush;

wherein the electrically insulated spherical magnetic particles have an electrical resistivity of more than $10^8$ Ω.cm, wherein the electrical resistivity of the electrically insulated spherical magnetic particles is obtained by measuring an electric current that flows between a load of 1 kg/cm$^2$ provided on a container containing said spherical magnetic particles and a bottom electrode provided on said container, said container having a cross-sectional area of 0.5 cm$^2$, and said load being applied to said spherical magnetic particles in said container when an electrical field of 1000 V/cm is provided between said load and said bottom electrode; and voltage source means for applying a superposed electric potential of a DC voltage and an AC voltage between the rotating sleeve and the image carrying member so that the DC voltage biases the rotating sleeve to a potential which is reverse in polarity to a charge of the toner.

2. The cleaning apparatus of claim 1, wherein absolute value of the DC voltage is between 0 to 300 volts.

3. The cleaning apparatus of claim 1, further comprising:

recovery means located in a direction which is downstream of the magnetic brush forming means when viewed relative to a rotating direction of the image carrying member, for recovering the electrically insulated spherical magnetic particles from the peripheral surface of the image carrying member.

4. The cleaning apparatus of claim 3, wherein the recovery means comprises:

a rotating recovery sleeve;

recovery magnet means provided in an inner space of the rotating recovery sleeve for generating a magnetic field to attract the electrically insulated magnetic particles from the image carrying member to an outer surface of the rotating recovery sleeve; and a voltage source for applying a DC bias potential between the rotating recovery sleeve and the image carrying member.

5. A cleaning apparatus of a magnetic brush type for removing residual toner from an image carrying member of an image former after a toner image has been transferred from the image carrying member, the cleaning apparatus comprising:

magnetic brush forming means having a rotating sleeve and a plurality of sleeve magnets arrayed in stationary and radial disposition in an inner space of the rotating sleeve, for forming a brush of electrically insulated magnetic particles on an outer surface of the rotating sleeve; and magnetic gate means provided outside of the rotating sleeve at a gate location, for controlling a flow of the electrically insulated magnetic particles onto the outer surface of the rotating sleeve by forming a control magnet pole, wherein the control magnetic pole is reverse in polarity to a nearest sleeve magnet pole which is nearest to the control magnetic pole among a plurality of magnetic poles of the sleeve magnets.

6. The cleaning apparatus of claim 5, wherein the magnetic gate means comprises an oscillatable member made of a magnetic substance, the oscillatable member being oscillatable between a first position close to the nearest magnetic pole and a second position spaced apart from the nearest magnetic pole, wherein the oscillatable member passes the flow of the electrically insulated magnetic particles through the gate location by taking the second position and stops the flow by inducing the control magnetic pole to take the first position.

7. The cleaning apparatus of claim 5, wherein the magnetic gate means comprises an electromagnet.

8. A cleaning apparatus of a magnetic brush type for use in an image former which develops an electrostatic latent image into a toner image of insulated chargeable toner on a peripheral surface of an image carrying member and transfers a toner image formed by a superimposing position onto a recording sheet, for removing residual toner, including toner having a spherical particle size of not more than 7 μm, after the transfer of the toner image from the peripheral surface, the cleaning apparatus comprising:

magnetic brush forming means having a rotating sleeve and a plurality of magnets located in stationary and radial dispositions in an inner space of the rotating sleeve, for forming a brush of electrically insulated spherical magnetic particles on an outer surface of the rotating sleeve so as to sweep the peripheral surface of the image carrying member by the magnetic brush;

voltage source means for applying a superposed electric potential of a DC voltage and an AC potential voltage between the rotating sleeve and the image carrying member so as to bias the rotating sleeve to a potential which is reverse in polarity to a charge of the toner;

wherein the electrically insulated spherical magnetic particles have an electrical resistivity of more than $10^8$ Ωcm, wherein the electrical resistivity of the electrically insulated spherical magnetic particles is obtained by measuring an electric current that flows between a load of 1 kg/cm$^2$ provided on a container containing said spherical magnetic particles and a bottom electrode provided on said container, said container having a cross-sectional area of 0.5 cm$^2$, and said load being applied to said spherical magnetic particles in said container when an electrical field of 1000 V/cm is provided between said load and said bottom electrode; and recovery means located in a direction which is downstream of the magnetic brush forming means when viewed relative to a rotating direction of the image carrying member, for recovering the electrically insulated magnetic particles from the peripheral surface of the image carrying member.

* * * * *